US007797901B2

(12) United States Patent
Near

(10) Patent No.: US 7,797,901 B2
(45) Date of Patent: Sep. 21, 2010

(54) DEMOUNTABLE WALL SYSTEM AND METHOD

(75) Inventor: Shannon D. Near, Grand Rapids, MI (US)

(73) Assignees: Quality Edge, Inc., Walker, MI (US); Wellness Inc., Nashville, TN (US)

( * ) Notice: Subject to any disclaimer, the term of this patent is extended or adjusted under 35 U.S.C. 154(b) by 463 days.

(21) Appl. No.: 12/008,466

(22) Filed: Jan. 11, 2008

(65) Prior Publication Data

US 2008/0209832 A1 Sep. 4, 2008

Related U.S. Application Data

(60) Provisional application No. 60/879,890, filed on Jan. 11, 2007.

(51) Int. Cl.
*E04C 2/08* (2006.01)

(52) U.S. Cl. ..... 52/481.1; 52/481.2; 52/483.1; 52/489.1; 52/238.1

(58) Field of Classification Search ..... 52/238.1, 52/481.1, 481.2, 483.1, 489.1, 281
See application file for complete search history.

(56) References Cited

U.S. PATENT DOCUMENTS 1,296,936 A * 3/1919 Edwards, Jr. ..... 52/356
1,307,187 A * 6/1919 Disbro ..... 52/592.1
2,058,386 A 10/1936 Parsons
2,169,254 A * 8/1939 Kotrbaty ..... 52/364
2,356,309 A * 8/1944 Garbe ..... 52/481.2
2,410,922 A 11/1946 Balduf
3,016,116 A 1/1962 Clevenger
3,381,438 A * 5/1968 Bohnsack ..... 52/481.2
3,407,547 A 10/1968 Doke et al.
3,483,665 A 12/1969 Miller
3,553,915 A * 1/1971 Pasovoy ..... 52/241
3,609,933 A 10/1971 Jahn et al.
3,623,290 A 11/1971 Downing, Jr.
3,653,172 A 4/1972 Schwartz
3,696,569 A * 10/1972 Didry ..... 52/126.4
3,753,325 A 8/1973 Stanley et al.
3,862,530 A 1/1975 Martine
3,986,313 A 10/1976 Nelsson
D242,626 S 12/1976 Scrivener
D242,627 S 12/1976 Scrivener
D242,628 S 12/1976 Scrivener
4,000,596 A 1/1977 Magill et al.
4,018,020 A 4/1977 Sauer et al.
4,058,951 A * 11/1977 Dean ..... 52/656.1
4,106,251 A 8/1978 Nelsson (Continued)

*Primary Examiner*—Brian E Glessner
*Assistant Examiner*—James J Buckle, Jr.
(74) *Attorney, Agent, or Firm*—Price, Heneveld, Cooper, DeWitt & Litton, LLP

(57) ABSTRACT

A demountable wall system includes similarly configured channel segments having a hat-shaped center, a pair of center flanges, and L-shaped outer ends with fastener portions formed therein. A rigid stud having an I-shaped plan configuration is formed from a pair of the channel segments interconnected in a back-to-back relationship, wherein adjacent end flanges form outer stud faces against which wall panels are supported, and adjacent fastener portions form connector channels in which the wall panels are detachably retained. A header/footer track is formed from a channel segment connected with a flat base strip, and is attached to the opposite ends of the stud by stud extenders to define a frame on which the wall panels are supported.

29 Claims, 12 Drawing Sheets

U.S. PATENT DOCUMENTS 4,192,119 A * 3/1980 Murphy ..... 52/844
4,397,127 A * 8/1983 Mieyal ..... 52/241
4,546,584 A 10/1985 Mieyal et al.
4,566,241 A 1/1986 Schneller
4,817,356 A 4/1989 Scott
4,835,935 A 6/1989 Murphy
4,964,618 A * 10/1990 Kennedy et al. ..... 256/24
5,279,091 A 1/1994 Williams et al.
5,325,641 A 7/1994 Felton
5,647,186 A * 7/1997 Donaldson ..... 52/653.1
6,073,410 A 6/2000 Schimpf et al.
6,968,661 B2 11/2005 Kopish et al.
7,451,573 B2 * 11/2008 Orszulak et al. ..... 52/167.1
7,716,899 B2 * 5/2010 Beck et al. ..... 52/741.13
2003/0172607 A1 9/2003 Brandes
2004/0139684 A1 7/2004 Menendez
2008/0028702 A1 * 2/2008 Daudet ..... 52/210
2008/0168733 A1 * 7/2008 Tollenaar ..... 52/481.1

* cited by examiner

DEMOUNTABLE WALL SYSTEM AND METHOD

CLAIM TO PRIORITY

Applicant hereby claims the priority benefits under the provisions of 35 U.S.C. §120 to related Provisional Patent Application Ser. No. 60/879,890, filed Jan. 11, 2007.

BACKGROUND OF THE INVENTION

The present invention relates to demountable wall constructions for building interiors and the like, and in particular to a repositionable wall system having a unique channel segment that is used to make both the wall studs and the header and footer tracks, so as to achieve improved economy and efficiency.

Demountable wall systems, such as those disclosed in U.S. Pat. Nos. 3,623,290 and 3,986,313 are generally well known in the art, and are designed to provide fixed walls in the interior of a building, which can be dismantled and rebuilt at different locations. Heretofore, such prior wall systems required numerous individual parts and fittings to construct a demountable wall, which increases manufacturing costs, and renders the assembly and reconfiguration of the wall system relatively complex and time-consuming. Furthermore, many such wall systems use unique parts which cannot be used in other wall constructions, and require specially configured accessories, such as for plumbing, power, cable, drop-ceilings, etc. Sound attenuation and fire resistance are also important factors that are not adequately addressed by many prior demountable wall systems.

SUMMARY OF THE INVENTION

One aspect of the present invention is a demountable wall of the type having vertical support members mounted between horizontal header and footer members to define a rigid frame on which wall panels are supported to cover at least a portion of the frame. The demountable wall includes a plurality of rigid, similarly configured channels segments, each having a hat-shaped central portion defined by a flat web, a pair of legs extending outwardly from opposite sides of the web, and a pair of center flanges disposed generally parallel with the web and extending from the outer edges of the legs, as well as a pair of L-shaped outer portions having end flanges disposed generally perpendicularly with the web, and inwardly turned connector flanges projecting inwardly from interior sides of the end flanges, and including fastener portions formed therein. A rigid vertical stud having a generally I-shaped plan configuration is constructed from a pair of the channel segments disposed in a back-to-back relationship with the webs laterally aligned and rigidly interconnected, such that adjacent ones of the end flanges of the pair of channel segments define outer stud faces against which the wall panels are supported, and adjacent ones of the fastener portions on the connector flanges of the pair of channel segments define therebetween connector channels in which associated connector portions of the wall panels are securely, yet detachably, retained. A rigid horizontal track is shaped for connection with the ends of the studs, and is constructed from a channel segment and a generally flat base strip, which are disposed in a back-to-back, laterally aligned relationship, with the base strip rigidly connected with the web of the channel segment.

Another aspect of the present invention is a method for making a demountable wall of the type having vertical studs mounted between horizontal header and footer tracks to define a rigid frame on which wall panels are supported. The method includes selecting an elongate strip of deformable metal having a predetermined width. The strip is formed into a rigid channel having a hat-shaped central portion defined by a flat web, a pair of legs extending outwardly from opposite sides of the web, and a pair of center flanges disposed generally parallel with the web and extending from outer ends of the legs, as well as a pair of L-shaped outer portions having end flanges disposed generally perpendicularly with the web, and inwardly turned connector flanges projecting inwardly from interior sides of the end flanges, and including fastener portions formed therein. The method also includes positioning two substantially equal lengths of the channel in a back-to-back relationship with the web portions thereof abutting, and in lateral alignment, and rigidly interconnecting the web portions of the two lengths of channel to define a generally I-shaped, rigid stud, wherein the adjacent end flanges of the two channels are flush and define outer stud faces against which the wall panels are supported, and the adjacent fastener portions on the connector flanges of the two channels are flush and define therebetween connector channels in which associated connector portions on the wall panels are securely, yet detachably, retained. The method also includes forming a generally flat base strip having a predetermined length, and positioning the base strip and a substantially equal length of the channel in a laterally aligned, back-to-back relationship. The method further includes rigidly interconnecting the base strip with the web portion of the channel, and cutting the same to length to define the header and footer tracks, as well as rigidly connecting opposite ends of the stud with the header and footer tracks to define the frame, and mounting the wall panels on the frame to cover at least an associated portion of the frame.

Yet another aspect of the present invention is stud construction for demountable walls of the type having vertical studs mounted between horizontal header and footer tracks to define a rigid frame on which wall panels are supported to cover at least a portion of the frame. The stud construction includes a pair of rigid channel segments, each having a hat-shaped central portion defined by a flat web, a pair of legs extending outwardly from opposite sides of the web, and a pair of center flanges disposed generally parallel with the web and extending from the outer ends of the legs, as well as a pair of L-shaped outer portions having end flanges disposed generally perpendicular with the web, and inwardly turned connector flanges projecting inwardly from interior sides of the end flanges, and including fastener portions formed therein. The pair of the channel segments are disposed in a back-to-back relationship with the webs laterally aligned and rigidly interconnected, such that the adjacent ones of the end flanges of the pair of channel segments define outer stud faces against which the wall panels are supported, and adjacent ones of the fastener portions on the connector flanges of the pair of channel segments define connector channels in which associated connector portions of the wall panels are securely, yet detachably, retained.

Yet another aspect of the present invention is a demountable wall system which has fewer parts to reduce manufacturing and inventory costs, as well as to render assembly and reconfiguration sufficiently fast and simple that the same can be accomplished by even less skilled installers. Preferably, the wall system provides full width wallboard coverage across the wall for improved sound attenuation and fire resistance, and incorporates environmentally friendly components. The wall system has an uncomplicated design, along with a durable construction which can be easily and quickly assembled. The wall system is efficient in use, economical to manufacture, cable of a long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
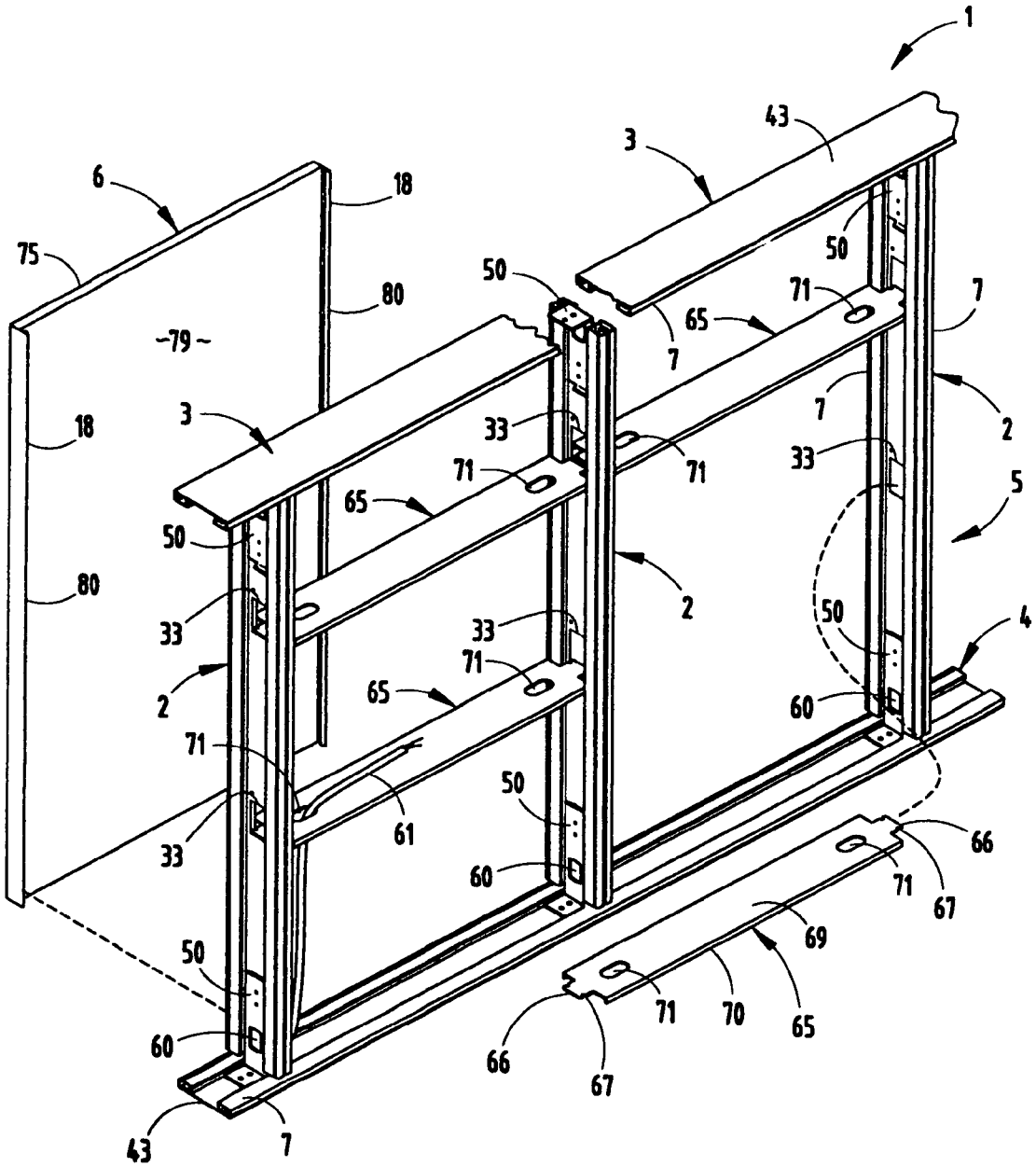
FIG. 1 is a perspective, exploded view of a demountable wall system embodying the present invention which includes interconnected studs and header/footer tracks.

For purposes of description herein, the terms "upper", "lower", "right", "left", "rear", "front", "vertical", "horizontal" and derivatives thereof shall relate to the invention in an installed condition, as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 7:
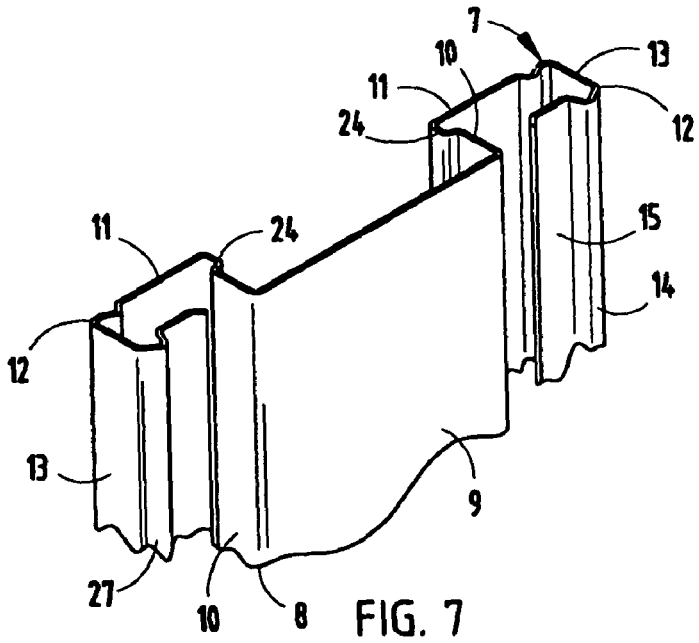
FIG. 7 is a fragmentary perspective view of a channel segment used to fabricate the stud and the header/footer track.
Figure 8:
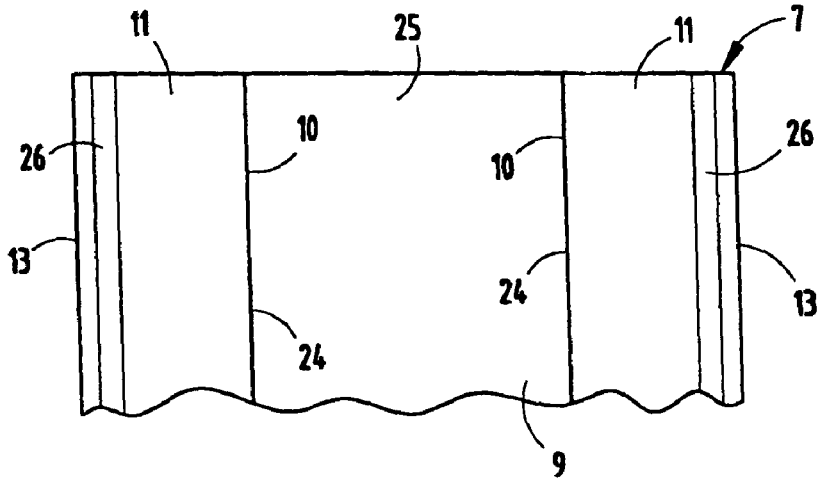
FIG. 8 is a fragmentary front elevational view of the channel segment.
Figure 9:
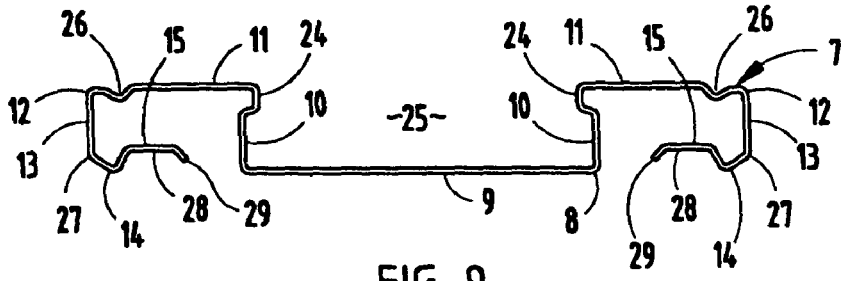
FIG. 9 is an end elevational view of the channel segment.
Figure 10:
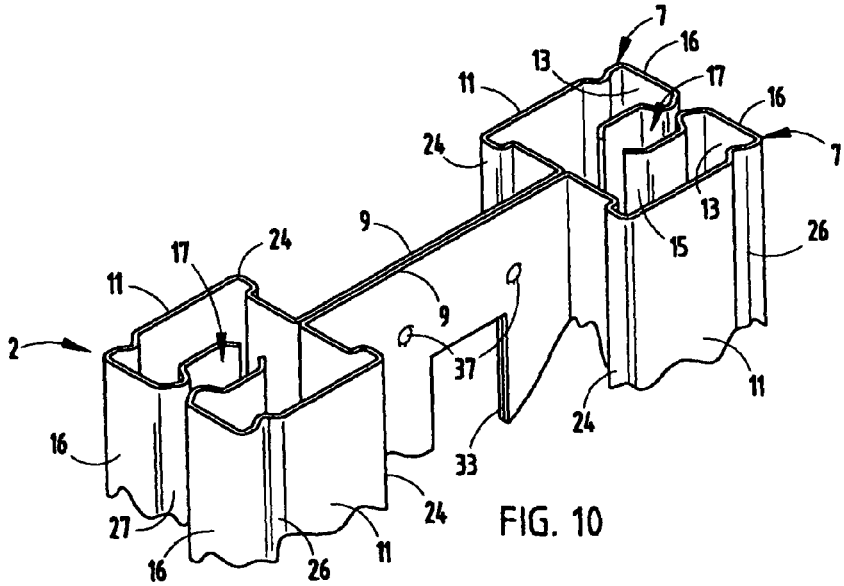
FIG. 10 is a fragmentary perspective view of the stud constructed from a pair of the channel segments.
Figure 11:
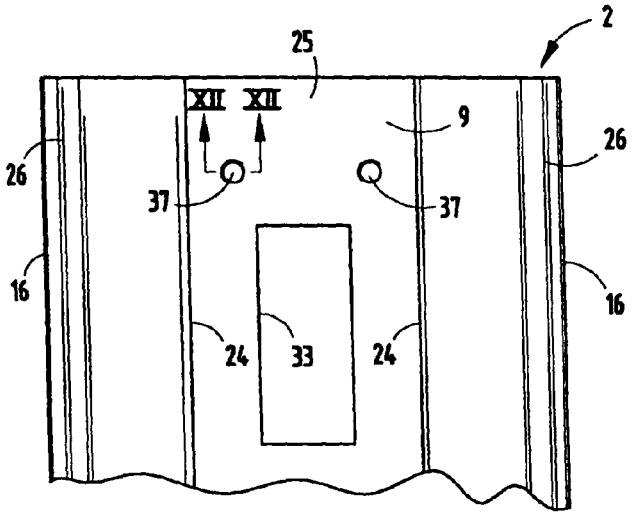
FIG. 11 is a front fragmentary elevational view of the stud.

The reference numeral 1 (FIG. 1) generally designates a demountable wall system embodying the present invention. Demountable wall system 1 includes a plurality of vertical studs 2 which are mounted between horizontal header and footer members 3, 4, which interconnect studs 2 in a laterally spaced apart relationship to define a generally open, rigid frame 5 on which removable wall panels 6 are detachably supported to cover at least a portion of frame 5. The studs 2 and the header/footer members 3, 4 are constructed from lengths of a common channel member 7, which as best illustrated in FIGS. 7-9, has a hat-shaped central portion 8 defined by a flat web 9, a pair of legs 10 extending outwardly from opposite sides of web 9, and a pair of center flanges 11 disposed generally parallel with web 9 and extending from outer ends of legs 10, as well as a pair of L-shaped outer portions 12 having end flanges 13 disposed generally perpendicular with web 9 and inwardly turned connector flanges 14 projecting inwardly from interior sides of end flanges 13 and including fastener portions 15 formed therein. As best illustrated in FIGS. 10-13, each stud 2 has a generally I-shaped plan configuration and is formed from a pair of channel segments 7 disposed in a back-to-back relationship with the webs 9 laterally aligned and rigidly interconnected, such that adjacent ones of the end flanges 13 of the pair of channel segments 7 define outer stud faces 16 against which the wall panels 6 are supported, and adjacent fastener portions 15 on the connector flanges 14 of the pair of channel segments 7 define therebetween connector channels 17 in which associated connector portions 18 of wall panels 6 are securely, yet detachably, retained. As best illustrated in FIGS. 14-17, each header/footer track 3, 4 is constructed from a channel segment 7 and a generally flat base strip 19, which are disposed in a back-to-back, laterally aligned relationship, with the base strip 19 rigidly connected with the web 9 of the channel segment 7.

With reference to FIGS. 7-9, the illustrated channel segment 7 is constructed from roll formed sheet metal, such as aluminum, steel or the like. The channel segment 7 illustrated in FIGS. 7-9 includes a pair of generally U-shaped, inwardly protruding ribs 24 disposed between the legs 10 and the center flanges 11, which serve to rigidify channel segment 7, and also form a necked retainer channel 25 into which portions of connector brackets are snap fit, as discussed in greater detail below. Each of the illustrated channel segments 7 also includes a pair of generally V-shaped, outwardly opening troughs 26 disposed along the outer portions of the center flanges 11 adjacent to end flanges 13. The connector flanges 14 of each of the illustrated channel segments 7 also include an angled outer portion 27 which is inclined to facilitate insertion of the connector portion 18 of wall panel 6 into the connector channel 17, and a generally U-shaped, inwardly opening inner portion 28 arranged to detachably capture the connector portion 18 of a wall panel 6 in connector channel 17. The end edges 29 of connector flanges 14 angle inwardly and are permitted to resiliently flex in a lateral direction to facilitate securely retaining the connector portions 18 of wall panels 6 in the connector channels 17. In the illustrated example, those lengths of channel segment 7 which will be used to construct studs 2 are also provided with a plurality of rectangularly-shaped apertures or windows 33 (FIGS. 10 and 11) extending laterally through the central portion of flat webs 9 for purposes to be described in greater detail hereinafter. Windows 33 are arranged in a regularly spaced apart pattern along the length of the channel segment 7. As shown in FIGS. 14-17, those lengths of channel segment 7 which are to be used to construct header/footer tracks 3, 4 preferably do not have windows 33 formed therethrough.

Figure 12:
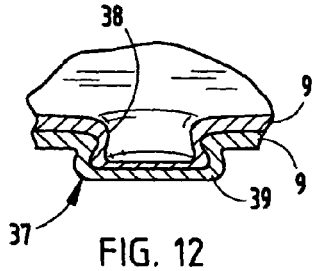
FIG. 12 is an enlarged cross-sectional view of a toggle lock portion of the stud taken along the line XII-XII, FIG. 11.
Figure 13:
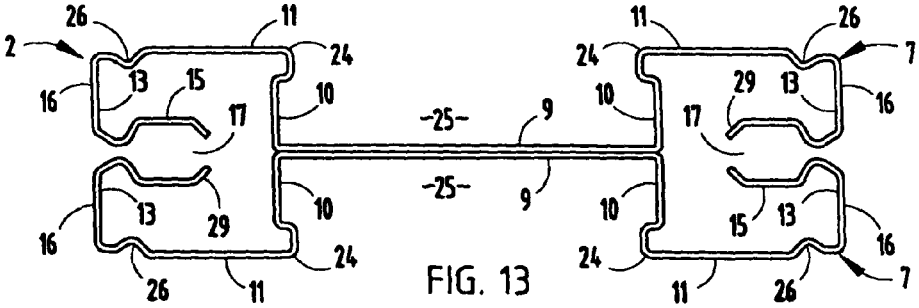
FIG. 13 is a plan view of the stud.
Figure 14:
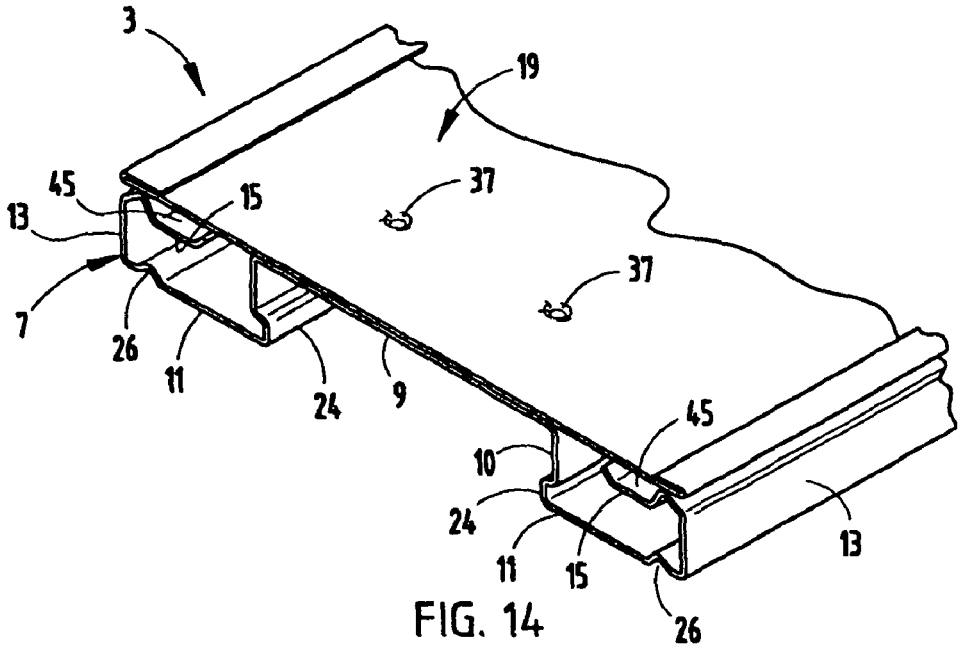
FIG. 14 is a fragmentary perspective view of the header/footer track.
Figure 15:
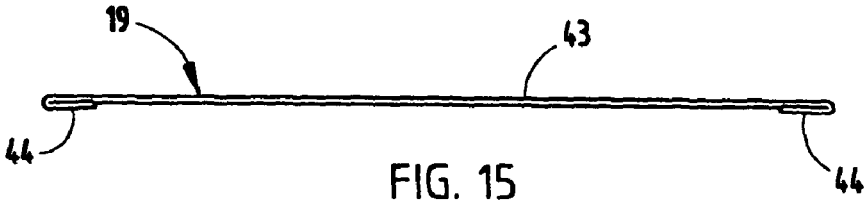
FIG. 15 is an end elevational view of a base strip portion of the header/footer track.
Figure 16:
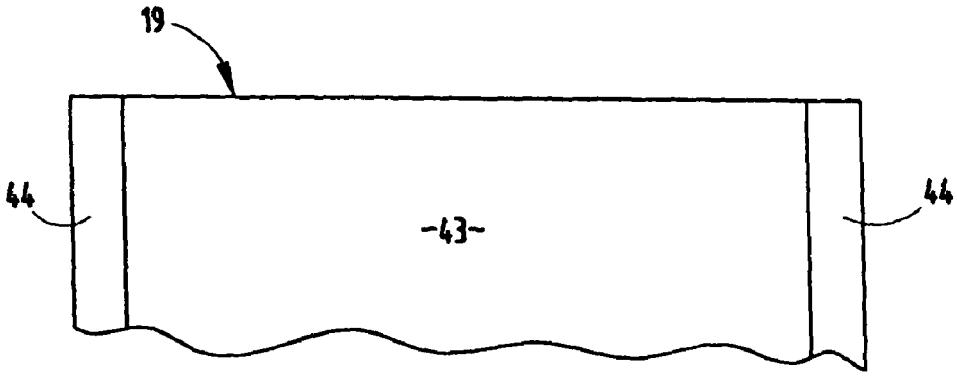
FIG. 16 is a fragmentary bottom view of the base strip.
Figure 17:
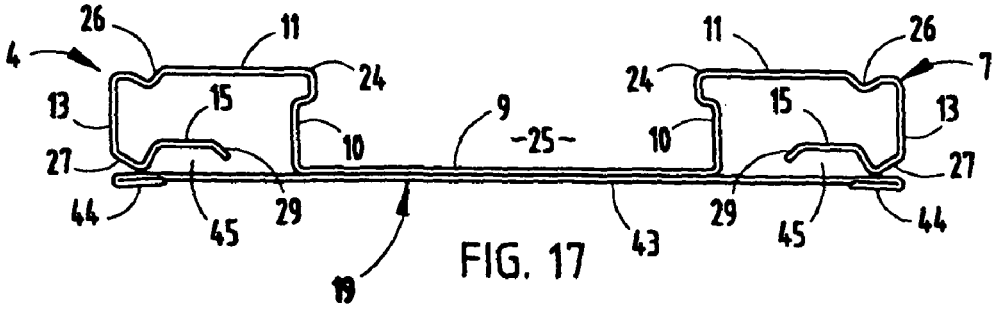
FIG. 17 is an end elevational view of the header/footer track.

As best illustrated in FIGS. 10-13, each stud 2 is constructed from two equal lengths of channel segment 7 of the type having windows 33 therethrough. The channel segments 7 for studs 2 are arranged in a back-to-back relationship with the webs 9 laterally aligned and rigidly connected, such that the adjacent flanges 13 define the outer stud faces 16 against which wall panels 6 are supported, and adjacent fastener portions 15 on connector flanges 14 define the connector channels 17 therebetween. In the illustrated example, the webs 9 of the two channel segments 7 forming stud 2 are rigidly interconnected by a plurality of toggle locks 37. More specifically, the two channel segments 7 illustrated in FIGS. 10-13 include laterally aligned pairs of toggle locks 37 spaced in a regular pattern along the length of the stud 2. Each toggle lock 37 has a generally conventional construction, which as best illustrated in FIG. 12, inelastically deforms the flat webs 9 to create tapered interlocking buttons 38 and 39 in the adjacent webs 7, which mechanically, fixedly interconnect the two channel segments 7 in the manner illustrated in FIGS. 10-13. In the illustrated example, each of the studs 2 has a predetermined width measured between the outer stud faces 16 of around 3⅝ inches, so as to accommodate conventional building wall accessories, such as plumbing and wiring mounts, drop ceiling tiles and the like.

With reference to FIGS. 14-17, the header/footer tracks 3, 4, which are also referred to generically herein as "tracks", are of an identical construction, wherein each comprises a length of channel segment 7 rigidly attached to an equal length of base strip 19. In the illustrated example, base strip 19 is constructed from roll formed sheet metal, such as aluminum, steel or the like, and includes a flat central web 43, with reverse bent side edges 44 that extend along the bottom sides of the header/footer tracks 3, 4 to add rigidity to the tracks. Preferably, base strip 19 has a width substantially commensurate with the width of the associated channel segment 7, such that the base strip 19 and the fastener portions 15 on the connector flanges 14 of the associated channel segments 7 define therebetween second connector channels 45 which securely, yet detachably, retain trim members therein, as described in greater detail hereinafter. In the illustrated example, base strip 19 is attached to the web 9 of the associated channel segment 7 by a plurality of toggle locks 37, substantially identical in construction to those used to form studs 2. Like studs 2, the header/footer tracks 3, 4 also have a width of around 3⅝ inches to accommodate conventional building wall accessories.

Figure 2:
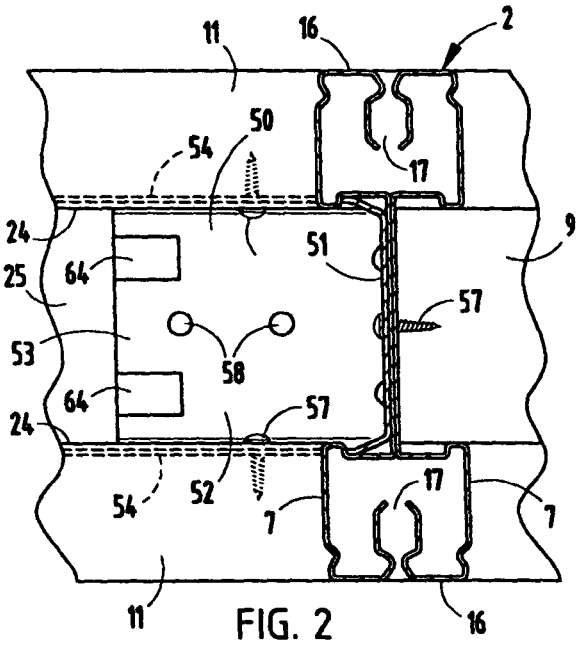
FIG. 2 is a fragmentary top plan view of a portion of the wall system, showing a stud connected with an associated track.
Figure 3:
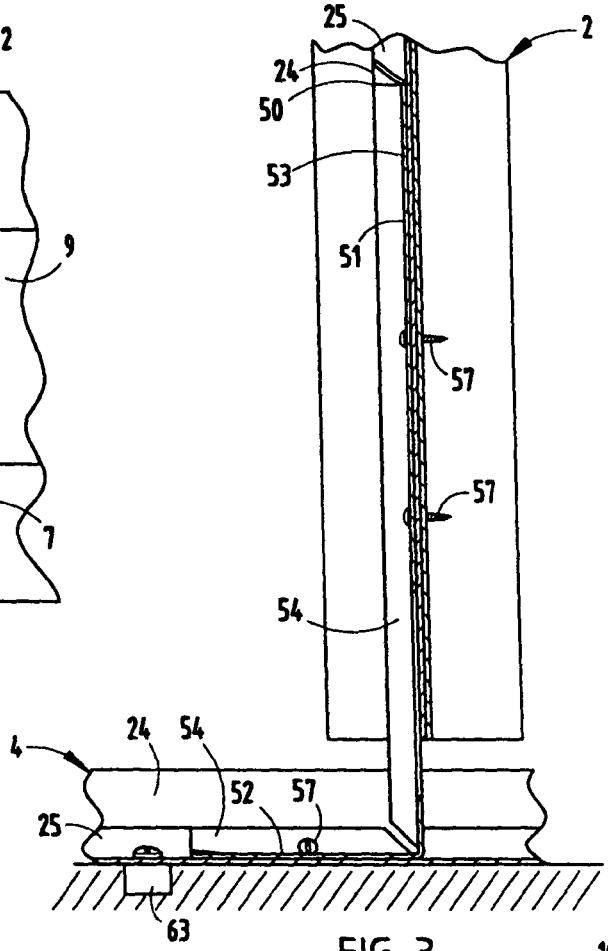
FIG. 3 is a vertical cross-sectional view of a portion of the wall system, showing the stud connected with an associated track.
Figure 6:
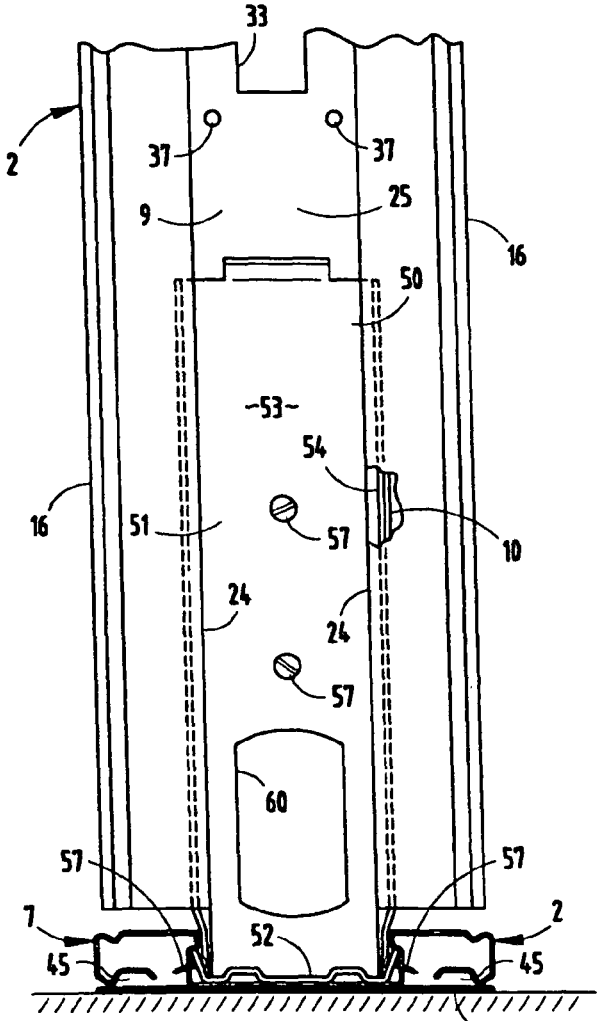
FIG. 6 is a fragmentary side elevational view of a stud connected with a footer track.

With reference to FIGS. 1-3, L-shaped connector-brackets or stud extenders 50 are used to interconnect the studs 2 with associated header/footer tracks 3, 4. Each connector bracket 50 includes a longer vertical leg 51 that is adapted for detachable connection with the webs 9 of an associated stud 2, and a shorter horizontal leg 52 that is adapted to be connected with the center portions of an associated header/footer track 3, 4. With reference to FIGS. 21-24, each illustrated connector bracket 50 has a generally U-shaped transverse cross-sectional configuration defined by a flat central web 53 and a pair of angled flanges 54 extending outwardly from opposite sides of web 53 at an included angle of around 109 degrees, such that they form a snap fit friction connection with studs 2 and header/footer tracks 3, 4 when the same are mounted in place between legs 10 in the retainer channel 25 of channel segment 7, as shown in FIGS. 2, 3 and 6, and discussed in greater detail below. The flanges 54 are cut at an angle at the intersection between legs 51 and 52 to accommodated formation into the L-shaped configuration shown in FIG. 22. The free end of vertical leg 51 also includes an angled tab 55 which facilitates inserting the vertical leg 51 of connector bracket 50 into the retainer channel 25 of an associated stud 2. The web portion 53 of vertical leg 51 also includes a pair of fastener apertures 56 through which fasteners, such as self-tapping or zip fasteners 57, are inserted to detachably mount connector bracket 50 to the webs 9 of an associated stud 2 in the manner illustrated in FIGS. 2 and 3. The web 53 (FIGS. 21-24) of the horizontal leg 52 similarly includes a pair of vertical fastener apertures 58 therethrough through which fasteners 57 (FIGS. 2 and 3) are inserted to attach connector bracket 50 to an associated header/footer track 3, 4. A pair of angled apertures 62 extend through the flanges 54 of horizontal connector leg 52 to facilitate attaching connector bracket 50 to a header/footer track that is mounted on a hard surface, such as the concrete floor shown in FIG. 3. In such installations, floor anchors 60 are typically used to attach footer track 4 to the hard floor surface, and fasteners 59 are inserted at an angle through apertures 62 and anchor in the legs 10 of the footer track 4. The illustrated horizontal connector leg 52 also includes a pair of U-shaped toes 64 at its free end which add rigidity to the leg 52. The illustrated connector bracket 50 (FIGS. 21-24) also includes an access or pass through window 60 through web 53 of vertical leg 51 adjacent horizontal leg 52, which permits passing utilities, such as cables and the like, therethrough for routing wiring 61 along the panel system in the manner illustrated in FIG. 1. In the illustrated example, connector brackets 50 are used at both the top and bottom of each stud 2 to mount the stud 2 to an associated header/footer track 3, 4, as shown in FIG. 1.

Figure 4:
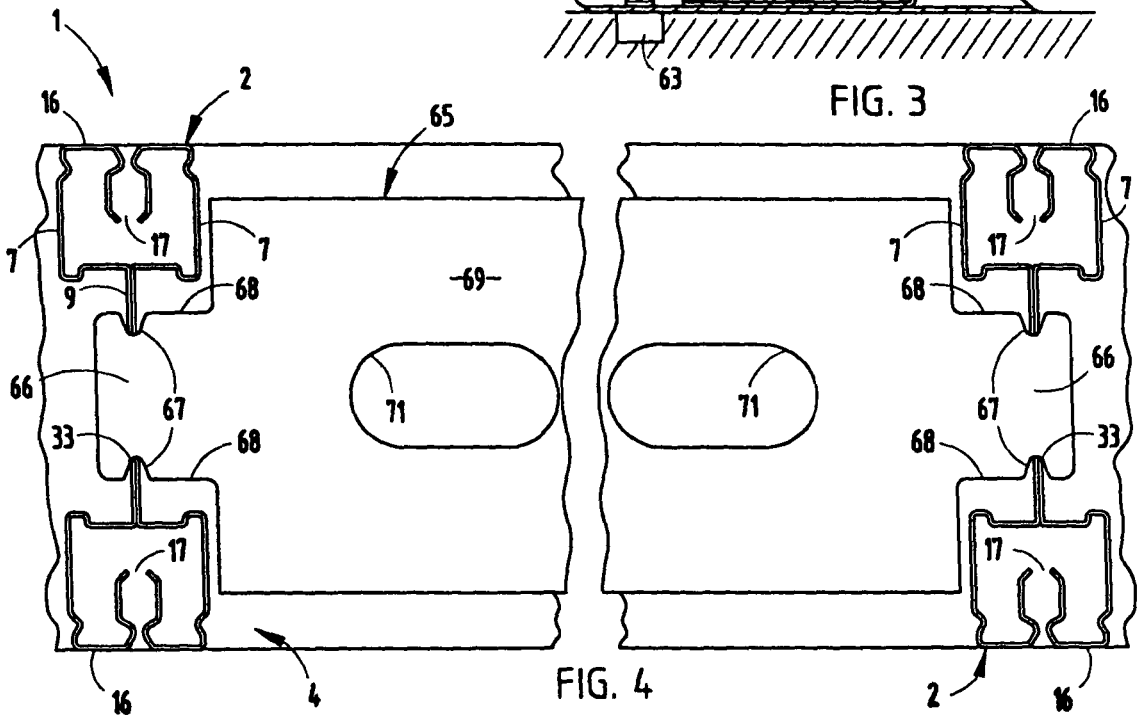
FIG. 4 is a plan view of a spacer bar mounted between a pair of the studs.
Figure 26:
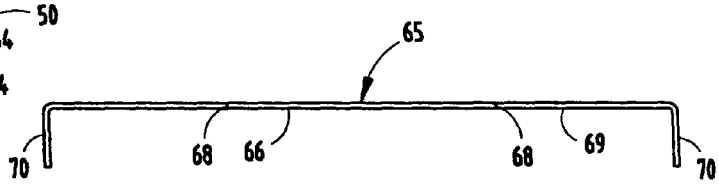
FIG. 26 is an end elevational view of the spacer bar.
Figure 25:
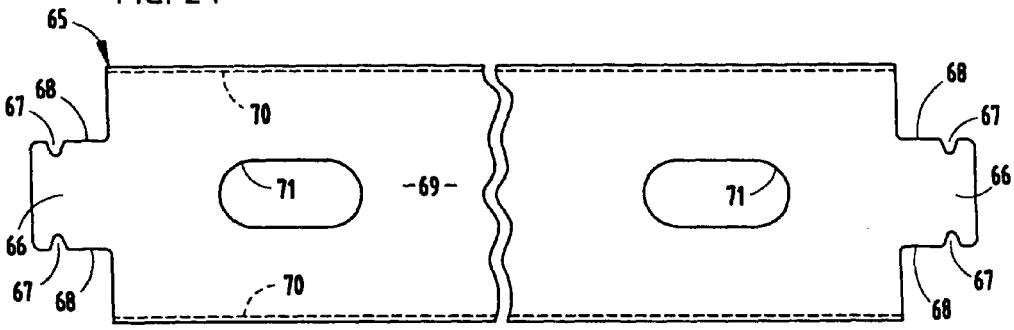
FIG. 25 is a fragmentary top plan view of a spacer bar.

The illustrated demountable wall system 1 also includes a plurality of rigid spacer bars 65 (FIGS. 1 and 4) which have a length shaped to span horizontally between adjacent ones of the studs 2, with a pair of connector tongues 66 projecting outwardly from opposite ends thereof, that are received in associated ones of the windows 33 in the studs 2 to detachably support spacer bar 65 between studs 2 and laterally rigidify the frame 5. Preferably, spacer bars 65 have a length configured for fastenerless, drop-into-place insertion into the windows 33 in studs 2. More particularly, the illustrated spacer bars 65 have a pair of laterally extending, V-shaped notches 67 (FIGS. 4 and 25) on the outer edge portions 68 of connector tongues 66 which receive therein the webs 9 of the studs 2 at the edges of windows 33 to positively, yet detachably, retain the adjacent studs 2 in a predetermined laterally spaced apart relationship. With reference to FIGS. 25 and 26, each of the illustrated spacer bars 65 has a generally U-shaped transverse cross-sectional configuration, defined by a flat central web 69 with a pair of flanges 70 extending downwardly from opposite sides thereof. Preferably, each spacer 65 has a predetermined width, as measured between flanges 70, which extends along major portions of the center flanges 11, so as to provide ample width to provide rigidity and route wiring therealong, as shown in FIG. 1. Furthermore, the illustrated spacer bar 65 includes laterally extending windows 71 therethrough which permit routing the wiring 61 vertically through the demountable wall.

Figure 5:
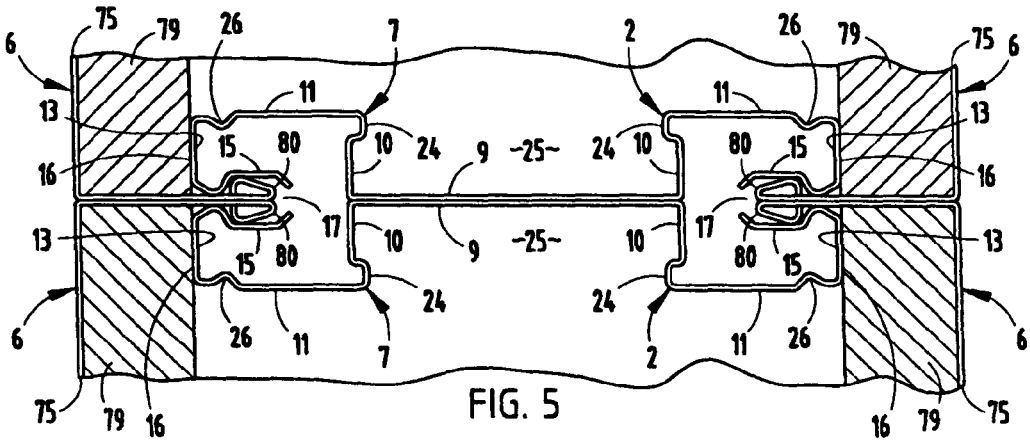
FIG. 5 is an enlarged, fragmentary plan view of a pair of wall panels attached to an associated stud.
Figure 18:
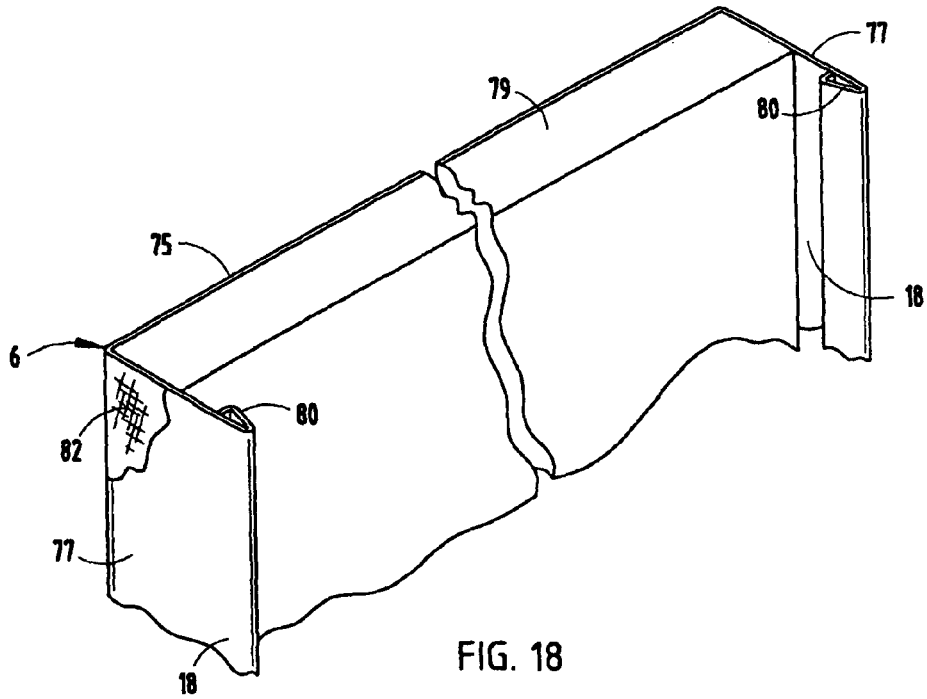
FIG. 18 is a fragmentary perspective view of a wall panel.
Figure 19:
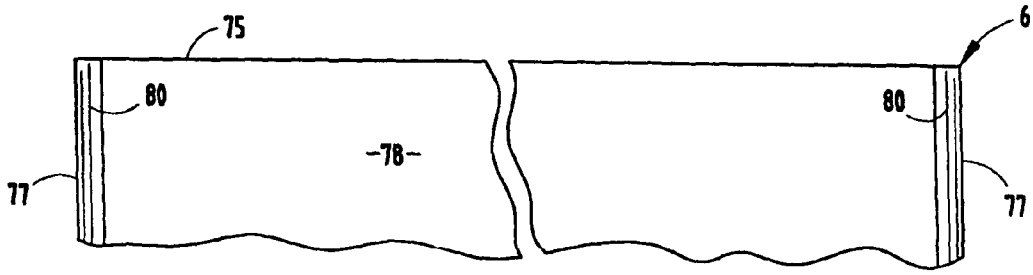
FIG. 19 is a fragmentary rear elevational view of the wall panel.
Figure 20:
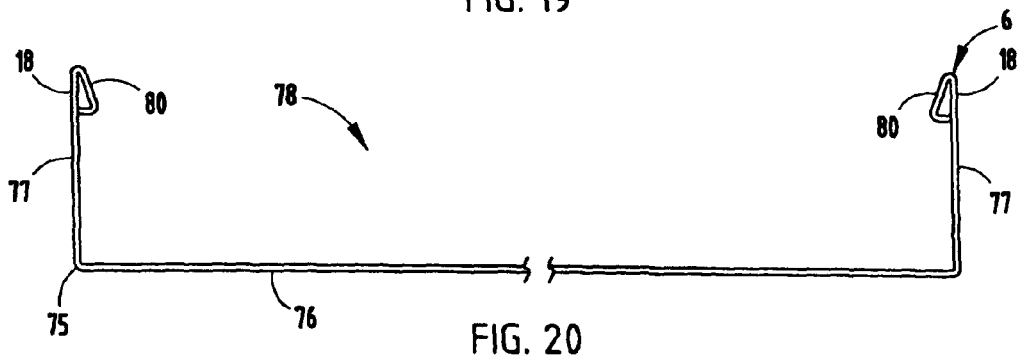
FIG. 20 is a fragmentary plan view of an exterior shell portion of the wall panel.
Figure 21:
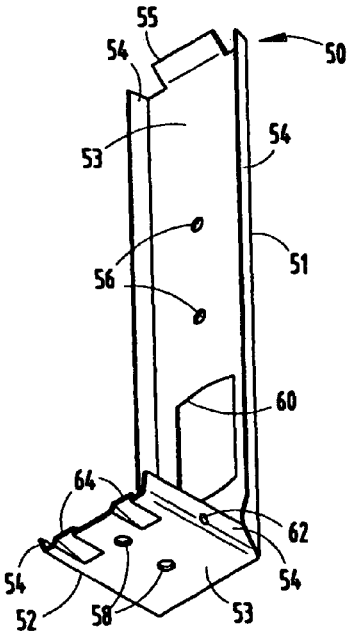
FIG. 21 is a perspective view of a connector used to connect a stud with an associated header/footer track.
Figure 22:
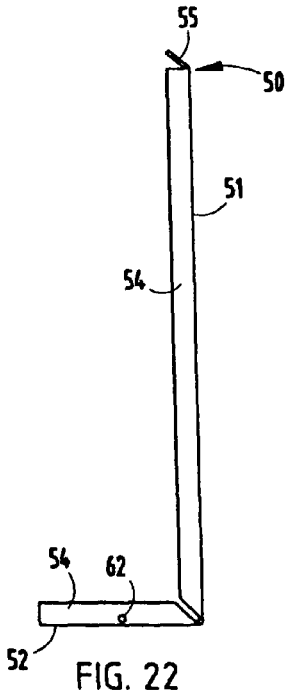
FIG. 22 is a side elevational view of the connector.
Figure 23:
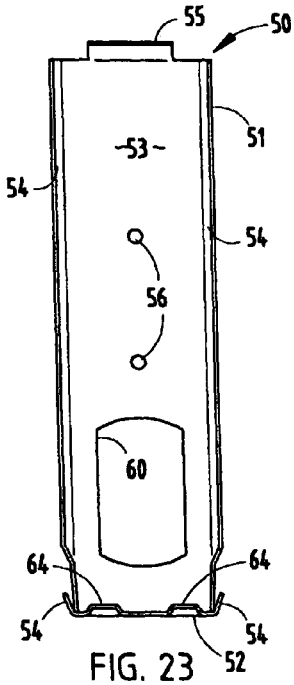
FIG. 23 is a front elevational view of the connector.
Figure 24:
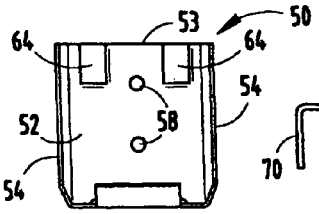
FIG. 24 is a bottom plan view of the connector.

With reference to FIGS. 18-20, each of the illustrated wall panels 6 includes a rigid, pan-shaped exterior shell member 75 having a generally flat forward face 76 with inwardly turned sidewalls 77 that define a channel 78 therebetween. A panel-shaped interior core member 79 is positioned in the channel 78 of exterior shell member 75, and is securely connected therewith by means such as adhesive or the like. Preferably, core member 78 is constructed from gypsum board or other similar materials, so as to provide substantial sound attenuation and fire resistance. Exterior shell member 75 is preferably constructed from sheet metal, such as aluminum, steel or the like, to provide additional sound attenuation and fire resistance. In the illustrated example, the sidewalls 77 of the exterior shell member 75 form connector strips 18 that protrude inwardly from the interior face of core member 78 and include triangularly-shaped barb members 80 which are configured for close reception within the connector channels 17 of studs 2. In the illustrated example, barbs 80 are formed integrally in the exterior shell 75 along the free edges of sidewalls 77, and have a right triangular lateral cross-sectional shape with a rounded corner at the apex. Barbs 80 provide constant spring tension, and securely, yet removably, retain the wall panels 6 on studs 2 without rattling. Preferably, each of the wall panels 6 has a predetermined thickness as measured between the face 76 of exterior shell member 75 and the interior surface of core member 79 of around ⅝ inches to accommodate conventional building wall accessories. Furthermore, as best illustrated in FIG. 5, wall panels 6 preferably have a width which spans between and overlaps at least portions of the outer stud faces 16 to provide full width sound attenuation and fire resistance. The sidewalls 77 of adjacent ones of the wall panels 6 mate in a flush relationship when assembled onto an associated stud 2 in the manner illustrated in FIG. 5 to define a finished, trim-free junction. In one embodiment of the present invention, wall panels 6 include a decorative film 82 (FIG. 18) adhered to the exterior face of the shell member 75 for improved aesthetics.

Figure 36:
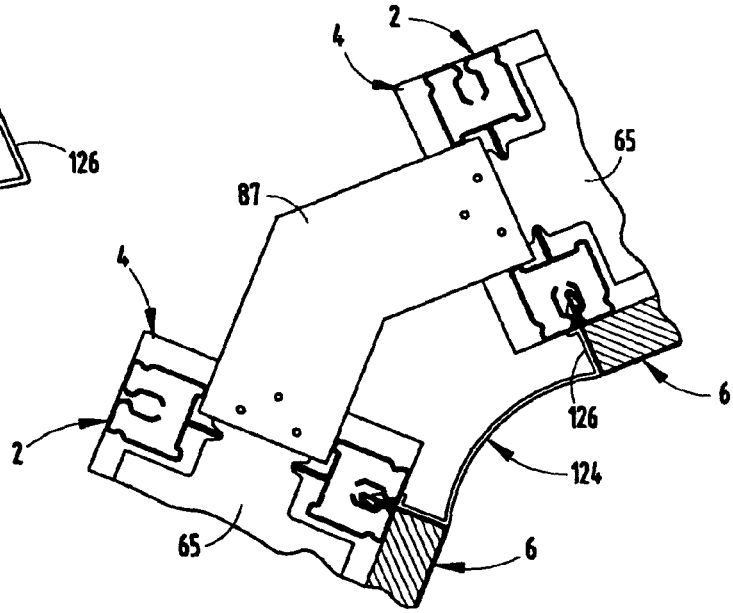
FIG. 36 is a top plan view of the curved interior angle trim, shown installed on two studs interconnected in an angled relationship.
Figure 40:
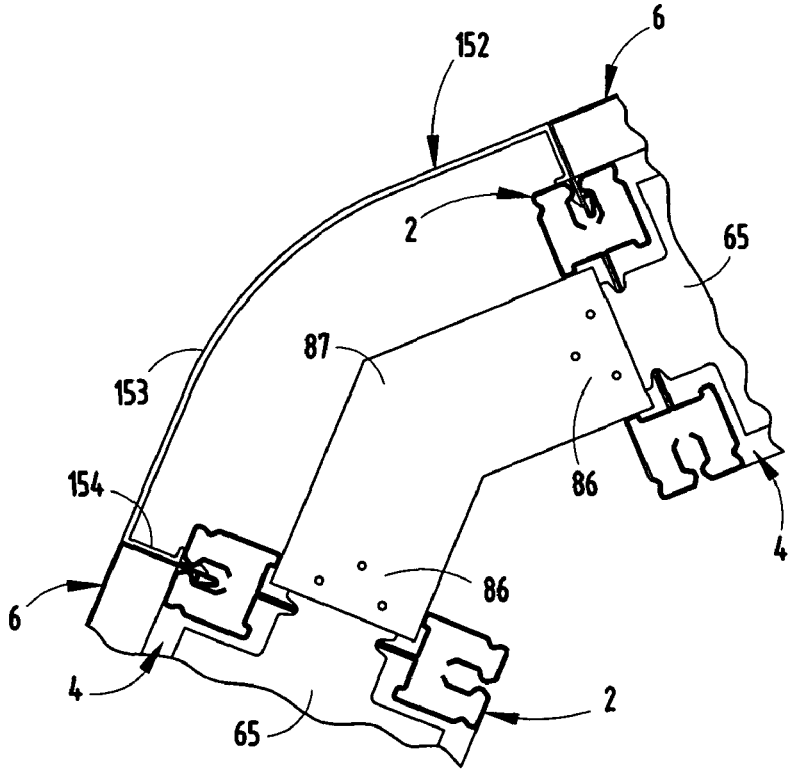
FIG. 40 is a top plan view of the curved exterior angled trim, shown installed between a pair of studs arranged in an angular relationship.

As best illustrated in FIGS. 28, 34, 36, 38 and 40, a plurality of differently configured splice plates 85 are provided to rigidly interconnect adjacent ends of header/footer tracks 3, 4. In the example illustrated in FIGS. 28, 34 and 38, splice plate 85 has a generally L-shaped plan configuration, with opposite ends 86 thereof connected with fasteners or the like to the central portion of adjacent footer tracks 4, which are oriented in a perpendicular relationship. FIGS. 36 and 40 illustrate a similar splice pate 87 for angle junctions.

Figure 27:
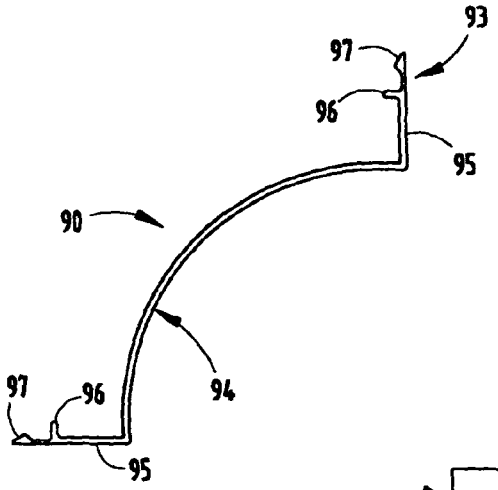
FIG. 27 is a top plan view of a curved interior right angle corner trim portion of the demountable wall system.
Figure 28:
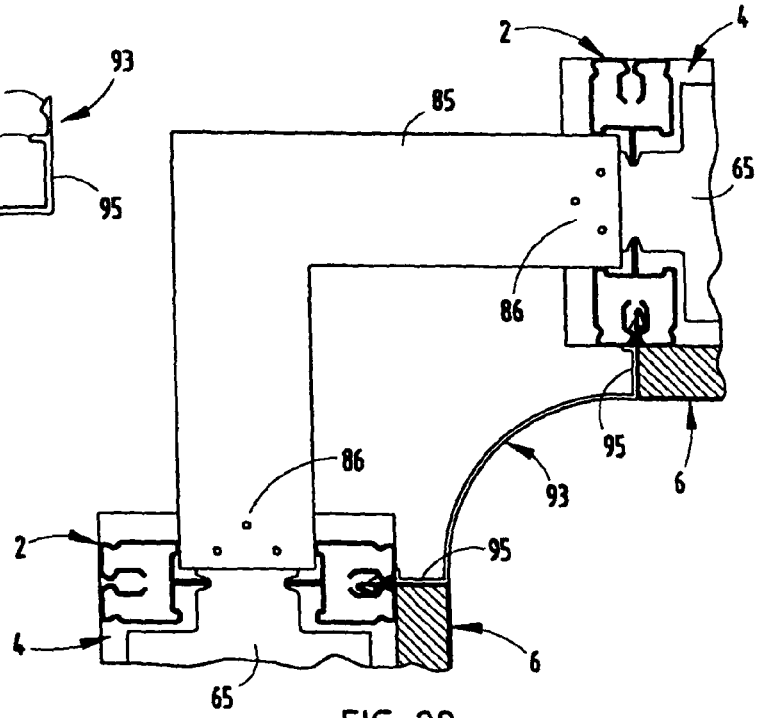
FIG. 28 is a top plan view of the curved interior right angle cover trim, shown installed between a pair of studs arranged at a 90 degree junction.

With reference to FIGS. 27-40, a plurality of differently configured trim members 90 are provided to improve the aesthetic appearance of the wall system. The trim members 90 may be constructed from a variety of different materials, such as synthetic resin, metal or the like, including the illustrated extruded aluminum construction. With reference to FIGS. 27 and 28, a curved interior joint trim strip 93 is provided to enclose the space that otherwise exists between adjacent wall segments when arranged in a perpendicular relationship, as shown in FIG. 28. More specifically, trim strip 93 includes a curved or arcuate central web 94 with a pair of flanges 95 extending inwardly from opposite sides thereof in a mutually perpendicular relationship. In the illustrated example, each flange 95 includes an inwardly extending stop rib 96, which abuts the outer stud faces 16 of the adjacent studs 2, and an interior barb 97, configured similar to the barbs 80 on wall panels, 6 which is securely, yet detachably, received within the connector channels 17 of the associated studs 2. In operation, the barbs 97 on flanges 95 of trim strip 93 are simply inserted into the connector channels 17 of adjacent studs 2 in the manner illustrated in FIG. 28, so as to cover or fully enclose the gap that would otherwise exist between the adjacent wall panels 6.

Figure 29:
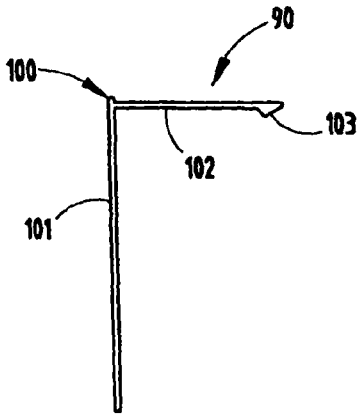
FIG. 29 is an end elevational view of a top/bottom trim portion of the demountable wall system.
Figure 30:
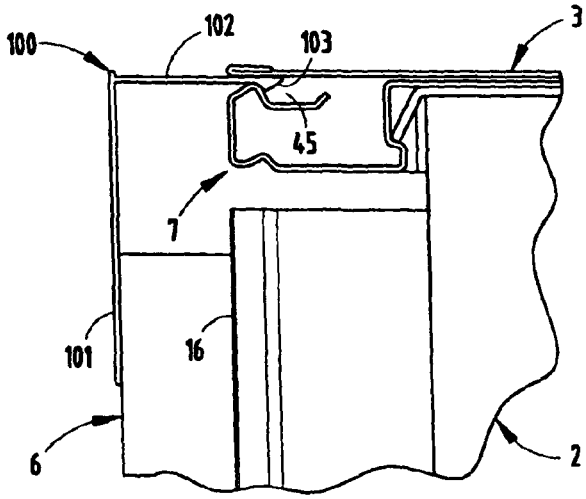
FIG. 30 is a side elevational view of the top/bottom trim, shown installed on an associated header track.

With reference to FIGS. 29 and 30, an L-shaped trim member is illustrated, and is adapted to cover any exposed edges of wall panels 6, such as at the upper and lower edges thereof, to provide a neat, even aesthetic appearance. More specifically, edge trim member 100 has an L-shaped plan configuration, comprising a face leg 101 which extends flush along the outer face of an associated wall panel 6 and a connector flange portion 102 which extends perpendicularly inwardly from face leg 101 and includes a triangularly-shaped barb 103 at the free end thereof which is shaped for close reception within the second connector channel 45 on the header/footer tracks 3, 4 in the manner illustrated in FIG. 30. Because the distance between the floor and ceiling of a building is typically irregular, a gap will often exist between the upper and lower edges of the wall panels 6 and the associated ceiling and floor of the building. Edge trim members 100 are inserted into the second connector channel 45 extending along the header and footer tracks 3 and 4 so as to enclose the gap which would otherwise exist between the upper and lower edges of the wall panels and the ceiling and floor of the building, thereby providing a neat, aesthetically pleasing appearance. Edge trim members 100 can also be used around window openings and other similar joints in the wall system 1.

Figure 31:
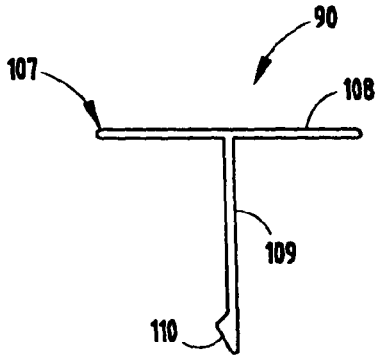
FIG. 31 is an end elevational view of a T-trim portion of the demountable wall system.
Figure 32:
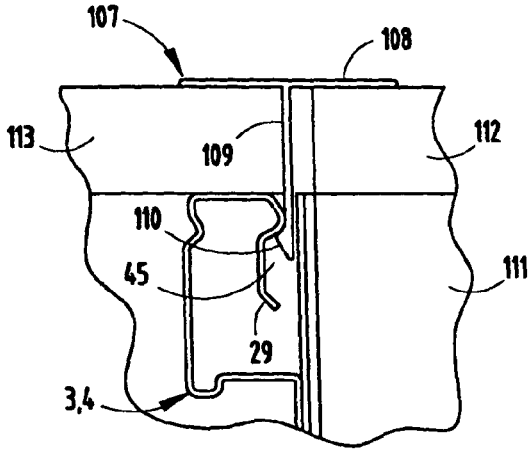
FIG. 32 is a top plan view of the T-trim shown installed on an associated stud.

With reference to FIGS. 31 and 32, a T-shaped trim member 107 is also provided to cover various joints in the wall system 1. T-trim 107 includes a flat face leg 108 which extends over and abuts the exterior faces of adjacent wall panels 6 and a central connector flange 109 which is disposed generally perpendicularly with respect to face leg 108 and includes a barb 110 at its free end. In the example illustrated in FIG. 32, T-shaped trim member 107 is used in a wall start application, wherein a section of header/footer track 3,4 is attached to an existing weight bearing wall, having a vertical stud 111 to which a conventional sheet of gypsum board 112 is fixedly mounted. Where the lateral space between the existing building wall and the wall system 1 is not of a standard width, a transition wall panel 113 can be formed by simply cutting a standard wall panel 6 to the desired width, as shown in FIG. 32. Since the connector strip 18 is thereby removed from the transition wall panel 113, the T-shaped trim member 107, which has its barb 110 inserted into connector channel 45 on header/footer track 3, 4 retains the cut edge of wall panel 113 securely against the associated outer face 16 of header/footer track 3, 4. The face flange 108 covers the cut edge of wall panel 113, as well as the gap that would otherwise exist with the building wall gypsum board panel 112.

Figure 33:
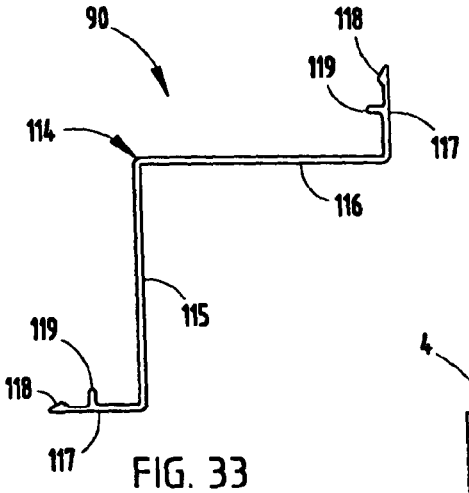
FIG. 33 is a top plan view of a square interior right angle trim portion of the demountable wall system.
Figure 34:
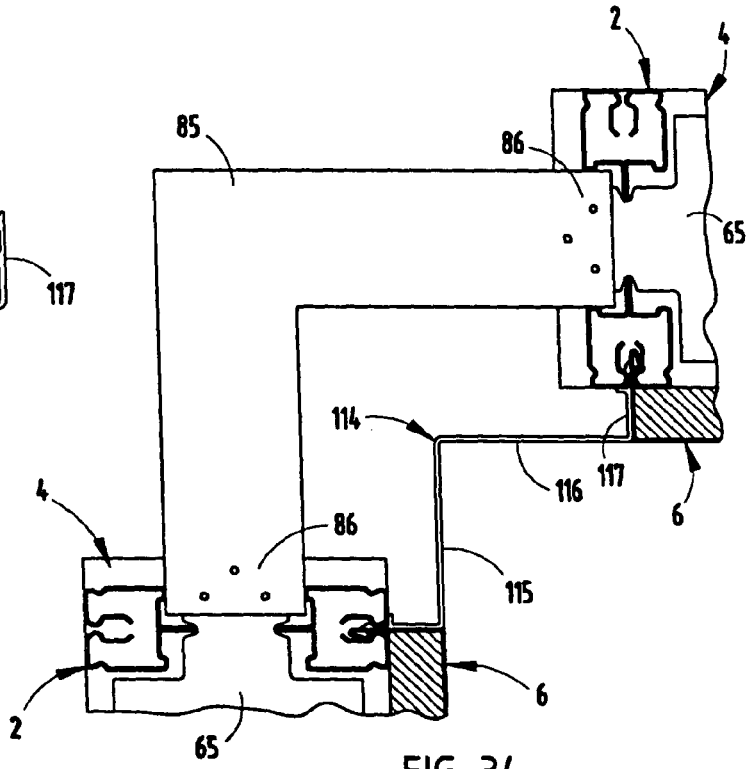
FIG. 34 is a top plan view of the square interior right angle trim, shown attached to adjacent studs at a 90 degree junction in the wall system.

With reference to FIGS. 33 and 34, a square interior joint trim member 114 is provided to enclose the space that otherwise exists between adjacent wall segments when arranged in a perpendicular relationship, as shown in FIG. 34, in a manner similar to previously described curved interior joint trim 93. More particularly, square trim member 114 has an L-shaped exterior face comprising flat, perpendicular legs 115 and 116, and a pair of connector flanges 117 which project inwardly from the ends of face legs 115 and 116 and are arranged in a mutually perpendicular relationship. Each of the connector flanges 117 includes a triangularly-shaped barb 118 extending along the free end thereof which is shaped for close reception within the connector channel 117 of associated studs 2. Each connector flange 117 also includes a stop rib 119 which extends inwardly from connector flange 117 and is configured to abut the outer stud faces 16 of the associated studs 2 in the manner illustrated in FIG. 34. In operation, the barbs 118 on flanges 117 of trim strip 114 are simply inserted into the connector channels 17 of adjacent studs 2 in the manner illustrated in FIG. 34 so as to cover or fully enclose the gap that would otherwise exist between the adjacent wall panels 6.

Figure 35:
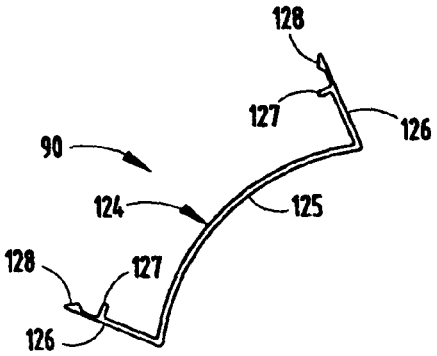
FIG. 35 is a top plan view of a curved interior angle trim portion of the demountable wall system.

With reference to FIGS. 35 and 36, a curved interior angle joint trim 124, somewhat similar to trim 93, is provided to cover the space that would otherwise exist when adjacent wall segments are interconnected in an angular relationship as shown in FIG. 36. More specifically, curved interior angle trim 124 includes a curved or arcuate web 125 with a pair of connector flanges 126 extending inwardly from opposite edges thereof in an angled relationship. Each of the connector flanges 126 includes a stop rib 127 positioned to abut the outer stud faces 16 of adjacent studs 2 and a barb 128 which is shaped for close reception within the connector channel 17 of adjacent studs 2. In operation, the barbs 128 on flanges 126 of trim strip 124 are simply inserted into the connector channels 17 of adjacent studs 2 in the manner illustrated in FIG. 36 so as to cover or fully enclose the gap that would otherwise exist between the adjacent wall panels 6.

Figure 37:
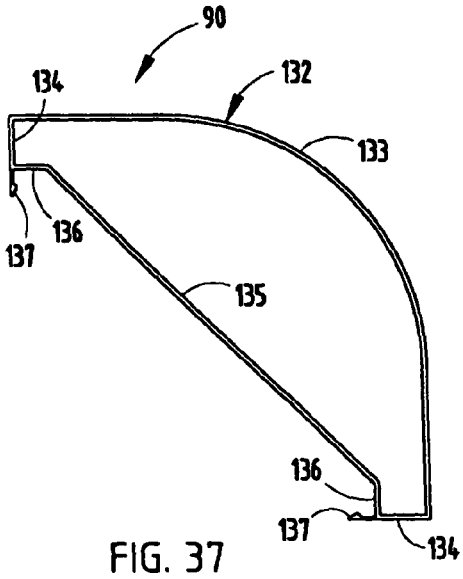
FIG. 37 is a top plan view of a curved exterior right angle trim portion of the demountable wall system.
Figure 38:
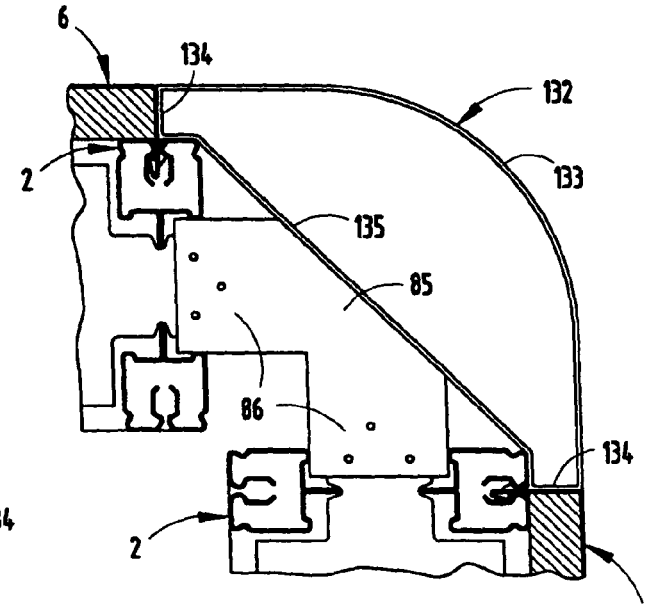
FIG. 38 is a top plan view of the curved exterior right angle trim shown installed between a pair of studs arranged in a 90 degree junction.

With reference to FIGS. 37 and 38, a curved exterior joint trim 132 is provided to cover the gap which would otherwise exist at the exterior of adjacent wall segments when arranged in a mutually perpendicular relationship as shown in FIG. 38. More specifically, curved exterior joint trim 132 includes a curved or arcuate web face 133 with a pair of connector flanges 134 extending inwardly from opposite ends thereof. An internal gusset web 135 extends between interior portions of connector flanges 134 to interconnect the same and add rigidity to the trim member 132. Gusset web 135 has squared end portions 136 which are shaped to abut the outer stud faces 16 of adjacent studs 2. The free ends of connector flanges 134 include triangularly-shaped barbs 137 which are shaped for close reception within the connector channels 17 of the adjacent studs 2 in the manner illustrated in FIG. 38. In operation, the barbs 137 on flanges 134 of trim strip 132 are simply inserted into the connector channels 17 of adjacent studs 2 in the manner illustrated in FIG. 38*s* so as to cover or fully enclose the gap that would otherwise exist between the adjacent wall panels 6.

Figure 39:
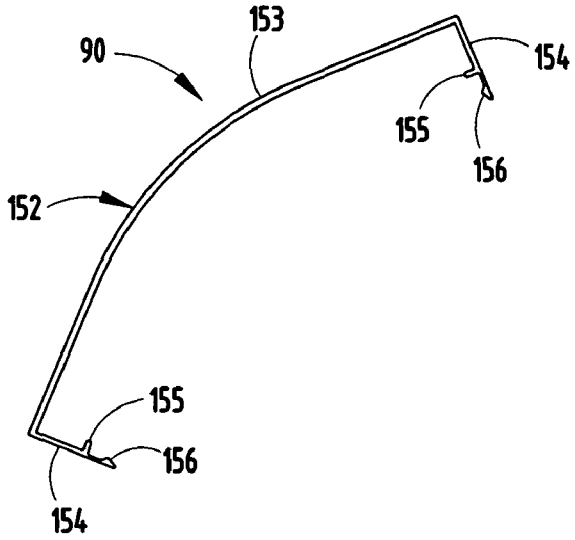
FIG. 39 is a top plan view of a curved exterior angled trim portion of the demountable wall system.

With reference to FIGS. 39 and 40, a curved exterior joint trim 152 is provided to enclose the space that would otherwise exist between adjacent wall segments when arranged in an angled relationship as shown in FIG. 40. More specifically, curved exterior joint trim 152 includes a curved or arcuately-shaped web face 153 with a pair of connector flanges 154 extending inwardly from opposite sides thereof. A pair of stop ribs 155 extend inwardly from the connector flanges 154 and are configured to abut the outer stud faces 16 of the associated adjacent studs 2 to properly locate trim member 152 over the associated joint space. Connector flanges 154 also include barbs 156 which extend along the free edges thereof and are shaped for reception within the connector channels 17 of the adjacent studs 2 in the manner illustrated in FIG. 40.

As will be apparent to those skilled in the art, studs 2 and header/footer tracks 3,4 are quite versatile, and can be used in a wide variety of interior building construction applications,. For example, sections of header/footer track 3, 4 can be used to frame a window opening in an associated demountable wall system 1 by simply cutting a pair of vertical and horizontal segments to length and mounting the same on associated studs 2. Trim members 100 or the like can be used to trim the otherwise exposed edges of the wall panels 6 around the perimeter of the window opening.

Furthermore, the present invention contemplates the use of conventional trim pieces, such as crown molding, chair rail, battens, bases, and the like, to trim out wall system 1, which is particularly beneficial to match the trim to that of existing building walls.

In operation, demountable wall system 1 is erected in the following manner. Footer tracks 4 are mounted on the floor of an associated building in the desired wall pattern, and header tracks 3 are mounted to the building ceiling directly over the footer tracks 4. Studs 2 are then positioned between the header and footer tracks 3 and 4, and the opposite ends of the studs 2 are connected to the header and footer tracks 3 and 4 using connector brackets 50. More specifically, the vertical legs 51 of two connectors 50 are snapped into the necked retainer channel 25 adjacent the top and bottom of an associated stud 2. The frictional contact created by the snap fit retains the connectors 50 in place, but permits manually sliding the connectors 50 along necked retainer channel 25 to the desired position. In order to overcome potential interference between connectors 50 and the heads of toggle locks 37 on the webs 9 of studs 2, the tab 55 at the upper end of connector 50 can first be inserted into the necked retainer channel 25, with the connector then being rotated, and shifted longitudinally along stud 2 to the desired position.

Spacer bars 65 are then inserted through the windows 33 of studs 2 and locked into place by engaging the notches 67 in the opposite tongues 66 with the edges of the stud webs which form the windows 33, thereby adding rigidity to the frame 5. Wiring 61 is then routed through the windows 60 in connector brackets 50, as well as the windows 33 in studs 2 and the windows 71 in spacer bars 65.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is as follows:

1. In a demountable wall of the type having vertical support members mounted between horizontal header and footer members to define a rigid frame on which wall panels are supported to cover at least a portion of said frame, the improvement comprising:

a plurality of rigid, similarly configured channel segments, each having a hat-shaped central portion defined by a flat web, a pair of legs extending outwardly from opposite sides of said web and a pair of center flanges disposed generally parallel with said web and extending from outer ends of said legs, as well as a pair of L-shaped outer portions having end flanges disposed generally perpendicular with said web, and inwardly turned connector flanges projecting inwardly from interior sides of said end flanges and including fastener portions formed therein;

a rigid vertical stud having a generally I-shaped plan configuration and comprising a pair of said channel segments disposed in a back-to-back relationship with said webs laterally aligned and rigidly interconnected, such that the adjacent ones of said end flanges of said pair of channel segments define outer stud faces against which said wall panels are supported, and the adjacent ones of said fastener portions on said connector flanges of said pair of channel segments define therebetween connector channels in which associated connector portions of said wall panels are securely, yet detachably, retained; and a rigid horizontal track shaped for connection with one of the ends of said stud, and comprising one said channel segment and a generally flat base strip, which are disposed in a back-to-back laterally aligned relationship, with said base strip rigidly connected with said web of said one channel segment.

2. A demountable wall as set forth in claim 1, wherein:

said base strip has a width substantially commensurate with the width of said one channel segment, such that said base strip and said fastener portion on said connector flange of said one channel segment define therebetween a second connector channel shaped to securely, yet detachably, retain a trim member therein.

3. A demountable wall as set forth in claim 2, wherein:

at least one of said wall panels has a core width which spans between and overlaps at least portions of said outer stud faces to provide full width sound attenuation and fire resistance.

4. A demountable wall as set forth in claim 3, wherein:

at least one of said wall panels includes:

a rigid pan-shaped exterior shell member having a generally flat face with inwardly turned sidewalls defining a channel therebetween; and a panel-shaped interior core member positioned in said channel and connected with said exterior shell member.

5. A demountable wall as set forth in claim 4, wherein:

said exterior shell member includes connector strips protruding outwardly from said sidewalls of said exterior shell member and having terminal end portion thereof defining said connector portions and being closely received in associated ones of said connector channels of said stud.

6. A demountable wall as set forth in claim 5, wherein:

said stud has a predetermined width measured between said outer stud faces of around 3⅝ inches to accommodate conventional building wall accessories.

7. A demountable wall as set forth in claim 6, wherein:

said wall panels each have a predetermined thickness of around ⅝ inches to accommodate conventional building wall accessories.

8. A demountable wall as set forth in claim 7, wherein:

said sidewalls of adjacent ones of said wall panels mate in a flush relationship when assembled on said stud to define a finished, trim-free junction.

9. A demountable wall as set forth in claim 8, wherein:

at least one of said wall members has said interior core member constructed from gypsum board; and said one of said wall panels includes a decorative film adhered to an exterior face of said exterior shell member.

10. A demountable wall as set forth in claim 9, including:

at least one L-shaped connector having a vertical leg portion thereof detachably connected with said webs of said stud and a horizontal leg portion thereof detachably connected with said track.

11. A demountable wall as set forth in claim 10, wherein:

said vertical and horizontal leg portions of said connector have a width configured for close reception between said legs of said channel segments.

12. A demountable wall as set forth in claim 11, wherein:

said stud includes a plurality of apertures extending laterally through said webs in a longitudinally spaced apart arrangement along said stud.

13. A demountable wall as set forth in claim 12, including:

at least one rigid spacer bar having a length shaped to span horizontally between adjacent ones of said studs, with a pair of connector tongues projecting outwardly from opposite ends thereof which are received in associated ones of said apertures in said studs to detachably support said spacer bar between said studs to laterally rigidify said frame.

14. A demountable wall as set forth in claim 13, wherein:

said spacer bar has a length configured for fastenerless, drop-into-place insertion into said apertures in said studs.

15. A demountable wall as set forth in claim 14, wherein:

said spacer bar includes a pair of laterally extending notches on outer edge portions of said connector tongues which receive said webs of said studs therein to positively, yet detachably, retain said adjacent studs in a predetermined laterally spaced apart relationship.

16. A demountable wall as set forth in claim 15, wherein:

said spacer bar has a generally U-shaped lateral cross-sectional configuration to facilitate routing utilities therealong.

17. A demountable wall as set forth in claim 16, wherein:

said spacer bar includes a plurality of vertically extending apertures therethrough to facilitate routing of utilities through said frame.

18. A demountable wall as set forth in claim 17, including:

a plurality of toggle locks interconnecting said webs in said stud.

19. A demountable wall as set forth in claim 18, including:

a plurality of toggle locks interconnecting said base strip with said channel segment in said track.

20. A demountable wall as set forth in claim 19, including:

a first trim member shaped to cover selected portions of an associated one of said wall panels and having a connector portion thereof detachably retained in an associated one of said connector channels in said stud.

21. A demountable wall as set forth in claim 20, including:

a second trim member shaped to cover selected portions of an associated one of said wall panels and having a connector portion thereof detachably retained in said second connector channel in said track.

22. A demountable wall as set forth in claim 21, wherein:

each of said channel segments includes a pair of generally U-shaped, inwardly protruding ribs disposed between said legs and said center flanges which rigidify said channel segments.

23. A demountable wall as set forth in claim 22, wherein: each of said channel segments includes a pair of generally V-shaped, outwardly opening troughs disposed along outer portions of said center flanges adjacent to said end flanges.

24. A demountable wall as set forth in claim 23, wherein: said connector flanges of each of said channel segments include an angled outer portion arranged to facilitate insertion of a connector into said connector channel, and a generally U-shaped, inwardly opening inner portion arranged to detachably capture a connector in said connector channel.

25. A demountable wall as set forth in claim 24, wherein: said base strip portion of said track includes reverse bent side edges extending along a bottom side of said track to add rigidity to said track.

26. A demountable wall as set forth in claim 25, wherein: said connector includes an aperture extending laterally through said vertical leg portion to facilitate routing wiring therethrough.

27. A demountable wall as set forth in claim 1, including: at least one rigid spacer bar having a length shaped to span horizontally between adjacent ones of said studs, with a pair of connector tongues projecting outwardly from opposite ends thereof which are received in associated apertures in said studs to detachably support said spacer bar between said studs to laterally rigidify said frame.

28. A demountable wall as set forth in claim 1, including: at least one trim member shaped to cover selected portions of an associated one of said wall panels and having a connector portion thereof detachably retained in said connector channel in said stud.

29. A demountable wall as set forth in claim 2, including: at least one trim member shaped to cover selected portions of an associated one of said wall panels and having a connector portion thereof detachably retained in said second connector channel in said track.

* * * * *